US005681108A

United States Patent [19]

Miller

[11] Patent Number: 5,681,108

[45] Date of Patent: Oct. 28, 1997

[54] GOLF SCOREKEEPING SYSTEM

[76] Inventor: Alan Miller, 1520 Fairway Dr., Los Altos, Calif. 94024

[21] Appl. No.: 495,956

[22] Filed: Jun. 28, 1995

[51] Int. Cl.[6] ..... G06F 15/28

[52] U.S. Cl. ..... 364/411

[58] Field of Search ..... 273/32 R, 32 B, 273/162 A; 364/410, 411

[56] References Cited

U.S. PATENT DOCUMENTS

| | | | |
|---|---|---|---|
| 4,910,677 | 3/1990 | Remedio et al. | 364/410 |
| 5,095,430 | 3/1992 | Bonito et al. | 364/410 |
| 5,127,044 | 6/1992 | Bonito et al. | 379/88 |
| 5,283,733 | 2/1994 | Colley | 364/411 |
| 5,319,548 | 6/1994 | Germain | 364/410 |

*Primary Examiner*—Jessica Harrison
*Assistant Examiner*—Michael O'Neill
*Attorney, Agent, or Firm*—Fish & Richardson P.C.

[57] ABSTRACT

A small, lightweight, portable, handheld data processing system stores and retrieves golf information and operates as a golf scorekeeper using a voice recognition system. The system includes a memory device, data input and output devices, a data transfer device, and a data processor. The golf scorekeeping system is capable of inputting, outputting, and storing data using a combination of manual, visual, and audio elements. The golf scorekeeping system utilizes a voice-to-digital converter, a computer, and a voice synthesis device to allow data to be input, output, and stored using voice recognition commands. The golf scorekeeping system is also capable of transmitting and receiving information to and from other devices such as printers or personal computers.

11 Claims, 14 Drawing Sheets

GOLF SCOREKEEPING SYSTEM

The present invention relates generally to a data processing device that provides data related to golf scorekeeping. In particular, the present invention relates to a data processing system that includes a device that is handheld and provides for the vocal input and output of golf course and scoring data.

BACKGROUND OF THE INVENTION AND PRIOR ART

An individual participating in the game of golf has many requirements. For example, before playing the individual must locate a golf course in his or her geographic area and determine when the course is open, the types of holes present at the course, and the availability of rental equipment. In addition, during play the individual must keep track of the number of strokes for each participant, the handicap for each participant, the honor or tee-off order for each participant, and other scoring information. Finally, after play a winner among all participants must be determined, and an individual might desire to keep track of past scores to analyze trends in his or her game.

In order to accommodate these requirements, various devices have been developed to provide golf course information, provide methods for keeping score during play, and provide methods for storing and retrieving past score information.

Simple golf scorekeeping devices using course guidebooks and scorecards have long existed, but these devices require a large amount of effort from the user to locate information, score particular holes, and compute statistics from prior golf rounds. Other golf scorekeeping devices have used microprocessors to assist in recording game information. These devices typically receive data from the user, including an individual golfer's handicap, the number of strokes per hole, the number of fairway drives, the number of greens reached in regulation, and the number of putts for a hole. Data received from internal memory includes course information such as a course's name, location, phone number, rental availability, and a slope and course rating. Data received from internal memory also typically includes scores from prior rounds.

These existing handheld microprocessor golf devices provide manual methods to input data. These manual methods typically use buttons or similar keypad devices which, when depressed, provide data in the form of commands or items of information to the data processor. Other manual methods to input data in handheld devices exist, including the use of pens, styluses, or similar pointing devices to manually enter data in the form of commands or other items of information to the data processor.

Existing handheld microprocessor golf devices also typically provide a visual means to output data. In these systems, data is transmitted from the data processor to the user by a visual display, such as a liquid crystal display or light-emitting diode display. Data in existing handheld data processors can also be transmitted to the user by sound emissions, involving items such as beeps, bells, or other simple tones. However, these sound emissions merely act as prompts or cues for the user to perform some other function, and do not convey information or otherwise perform data operations.

Audio recognition and synthesis technology has not been used in either the input or output of data in handheld golf scorekeepers. In general, audio recognition and synthesis technology encompasses the use of audio inputs to implement certain commands or operations by the data processor, the use of audio outputs to provide information to the user, and the recognition of specific sounds by the data processor. Data input is accomplished through the use of audio recognition technology features; the device recognizes sounds such as a user's vocal patterns and performs operations based on specific input patterns. In particular, the device receives input information from a microphone, manipulates this information in a voice-to-digital conversion device, and passes the data in its converted form to a data processor. Data output is accomplished through the use of audio synthesis technology; the device outputs data, including commands and other information, to the user in an audio manner easily recognized as speech emissions or other sounds. In particular, the data processor passes data to a voice synthesis apparatus, then manipulates the data as output information to a speaker or similar output device.

Finally, existing handheld golf scoring devices also do not allow the transmission of data to and from other devices, including printers and computing devices.

For the foregoing reasons, there is a need for a handheld golf scorekeeping system that provides a portable, lightweight, water-resistant, handheld golf scorekeeping system utilizing voice recognition technology and is capable of transmitting information to and from other external devices. Specifically, a need exists for a golf scorekeeping system that combines the advantages of existing handheld data processing devices and the advantages of audio recognition technology and audio synthesis technology, including speech recognition and speech synthesis. The required golf scorekeeping system would input certain data, operate on that input data, store the data, manipulate the data, output the data to the user, transmit the data to other devices, and receive the data from other devices. Such a system would utilize complex audio recognition technology features, including speech recognition, with the capability of recognizing and processing a large number of vocal commands, access a stored database of multiple records, and perform operations relating to that database. Finally, such a system would utilize audio synthesis technology features, including speech synthesis, in the form of prerecorded voice narratives to perform a wide variety of functions, such as prompting the user for data input and outputting different data to the user.

SUMMARY OF THE INVENTION

One object of the present invention is the provision of a data processing system which recognizes specific audio inputs as commands to manipulate data and broadcasts audio outputs to a user to disseminate specific items of data. Another object of the present invention is a data processing system that is handheld, portable, and water-resistant. Still another object of the present invention is a data processing system that stores relevant data in a database and manipulates specific items of data, outputting certain data to the user, calculating certain data for further use, and analyzing certain data for statistical samples. Yet another object of the present invention is the provision of a data processing system which is capable of transmitting data to and receiving data from other computing devices or other peripheral devices such as printers.

Generally, the present invention provides a small, lightweight, portable, handheld data processing system for storing and retrieving golf information and operating as a golf scorekeeper using a voice recognition system. The system includes a memory device, a data input device, a data output device, and a data transfer device, and a data processor. The data processor utilizes a voice-to-digital convention, a computer, and a voice synthesis device. The present invention further includes a system that inputs, outputs, and stores data with a combination of manual, visual, and audio elements. In particular, the present invention utilizes speech inputs and outputs as a specific form of audio data, and utilizes speech recognition and speech synthesis as a means for conducting data operations. The invention can recognize audio data as commands and execute actions or operations solely based on those audio commands or also in combination with certain keystrokes. The invention can also recognize audio data as information and store that data in a proper manner to allow subsequent operation and use. The invention has the capability to recognize a large amount of audio data and conduct operations based on that data. The present invention also permits the audio output and recall of data, including commands and actual items of information. The invention outputs data as an audio prompt for the user to input information, outputs data as an audio emission providing information to the user, or outputs data through a visual display. Finally, the present invention transmits data to and receives data from other devices such as printers or personal computers.

BRIEF DESCRIPTION OF THE DRAWINGS

The present invention will be better understood by reference to the accompanying drawings in which.

PREFERRED EMBODIMENT OF THE PRESENT INVENTION

Figure 1:
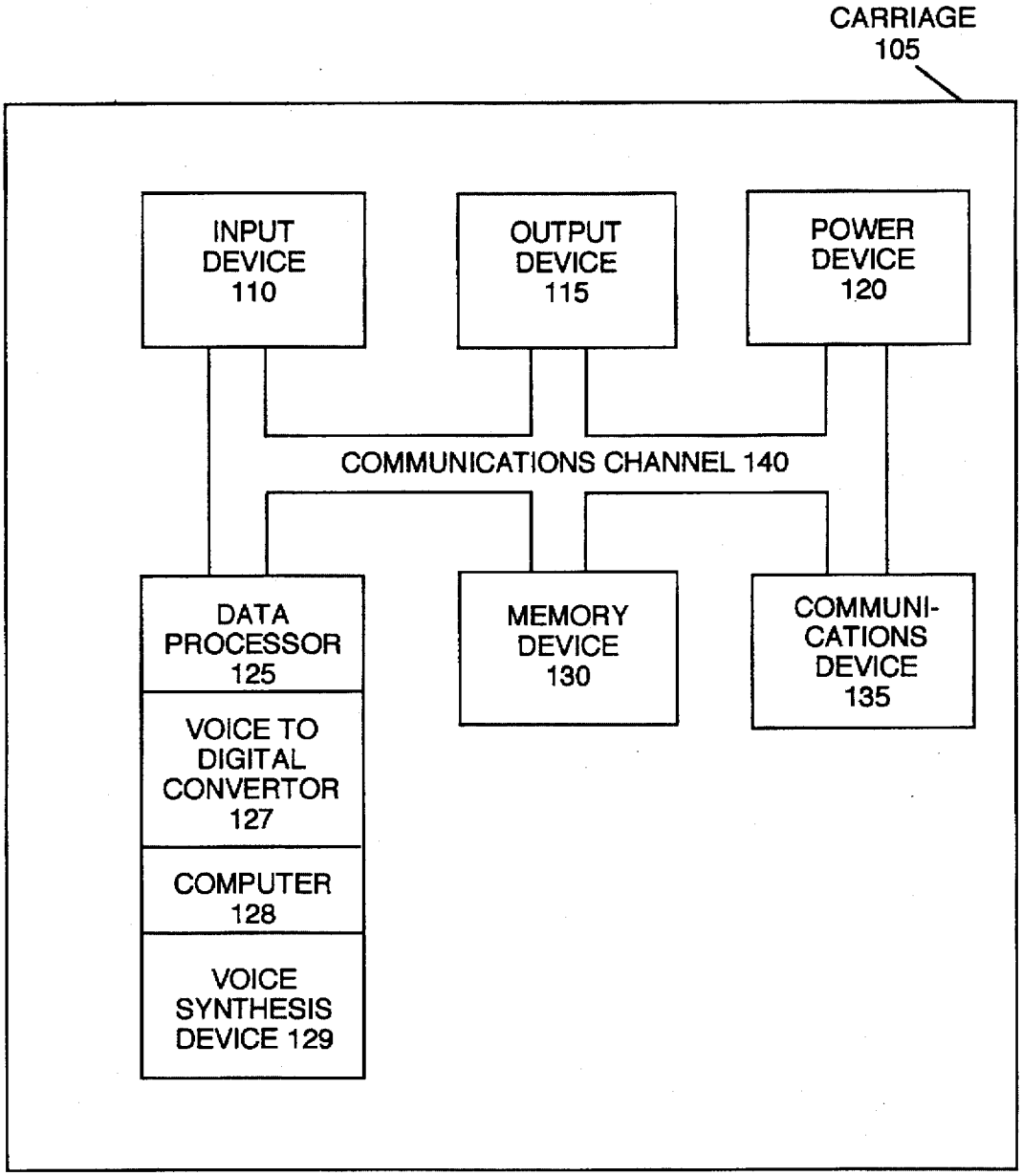
FIG. 1 is a block diagram of a configuration of components used in the present invention.
Figure 2:
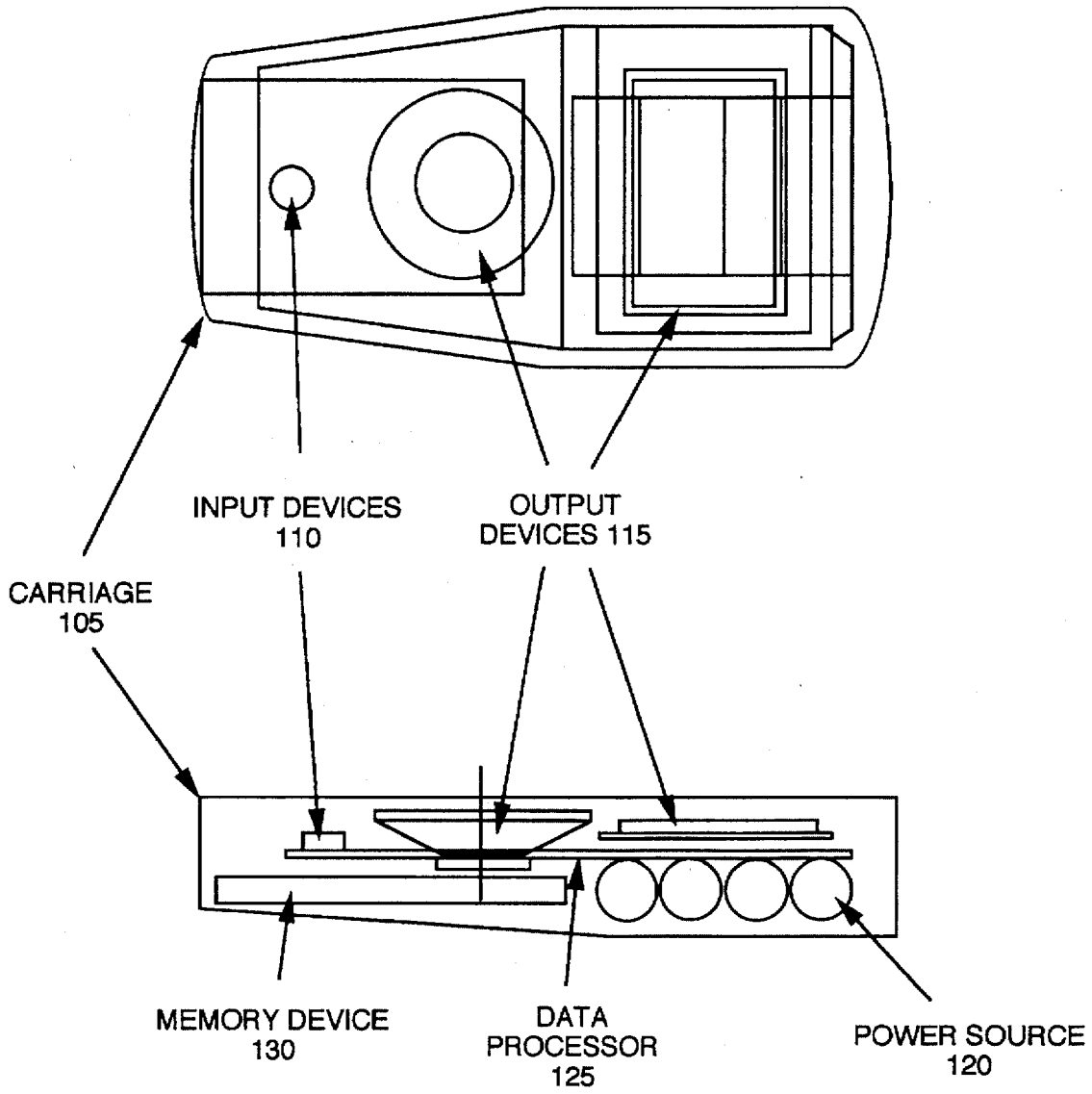
FIG. 2 depicts the top and side views of a data processing device according to the present invention, displaying certain components of the present invention.
Figure 3:
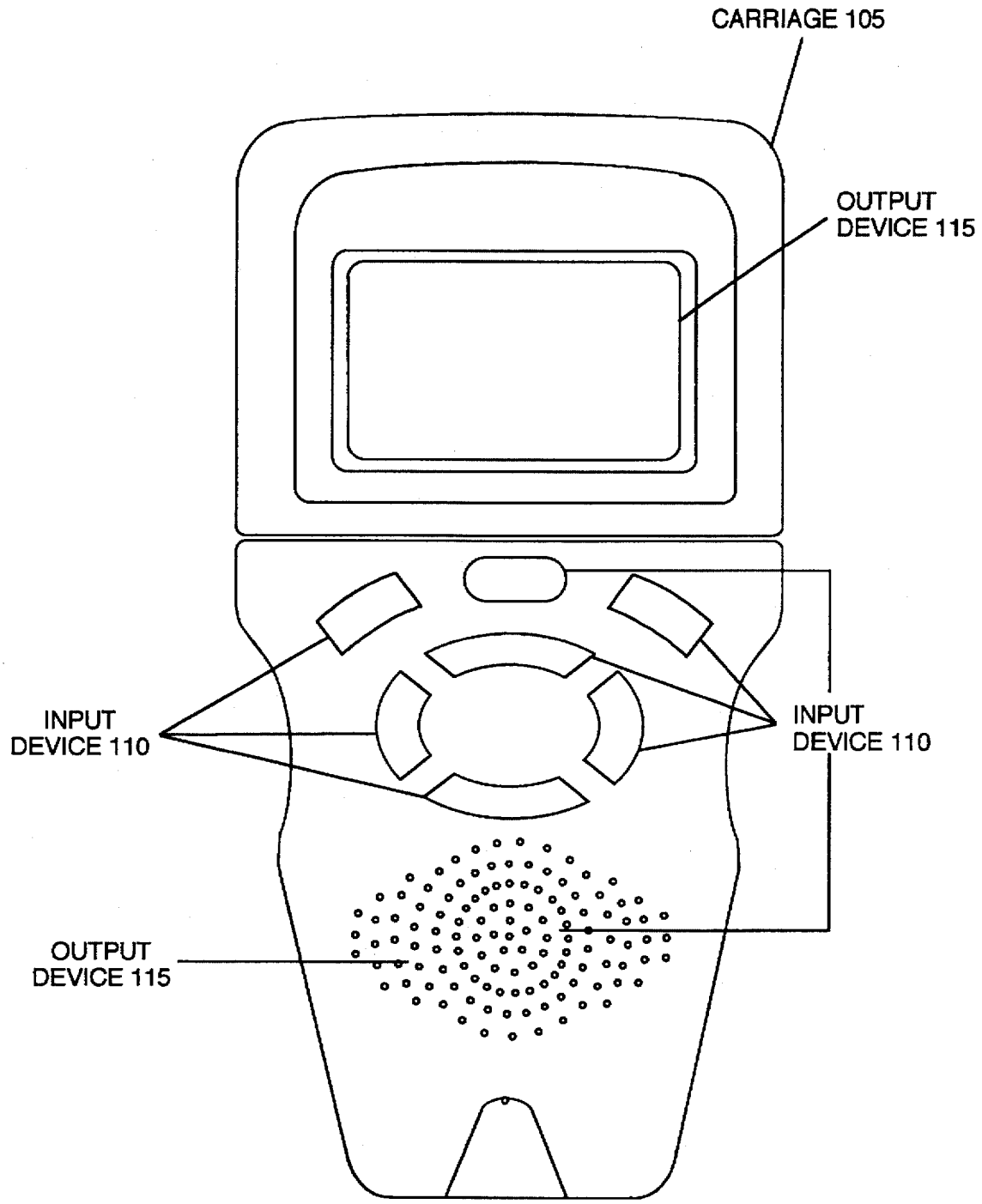
FIG. 3 depicts the top view of the preferred embodiment of the present invention, displaying certain components of the present invention.

As shown in FIGS. 1, 2, and 3 the present invention includes a carriage 105, various input devices 110, various output devices 115, a power source 120, a data processor 125, a memory device 130, a data communications device 135, and a communications channel 140. Data processor 125 further includes a voice-to-digital converter 127, a computer 128, and a voice synthesis device 129.

1. Individual Components

Carriage 105 is a frame suitably sized and weighted to allow the data processing device to be held easily by a user in one hand. Carriage 105 is also composed of water-resistant material to prevent moisture from coming into contact with the other devices connected to carriage 105. The preferred embodiment of the present invention utilizes a carriage that is a sculpted, handheld item approximately six inches long, approximately three and one-quarter inches across at the widest point, and approximately one and one-quarter inches thick at the thickest point. The preferred embodiment of carriage 105 is composed of several types of plastics, including an acrylic or polycarbonate cover for certain output devices 115, rubberized cover for certain input devices 110, and an acrylonitrile-butadiene-styrene or similar plastic cover for the remainder of carriage 105.

Included within carriage 105 are various input devices 110. These input devices 110 assist the user to input data into the handheld device. Input devices 110 can be manually operated structures, such as buttons or other keypad combinations commonly used in pocket calculators or personal data processors. Input devices 110 also can be audio components, such as microphones, to input and transmit data in audio form to other connected components. The preferred embodiment of the present invention utilizes both keybuttons and a microphone to input data; a series of keybuttons is used to input data manually and respond to certain prompts, while a microphone is used to input data verbally and respond to certain prompts. In particular, the preferred embodiment has four keybutton input devices designated "up", "down", "left", and "right", and two keybutton input devices designated "enter". These keybuttons are primarily used in conjunction with the output devices 115 to implement command selections. The preferred embodiment also utilizes a cylindrical, one-half inch diameter, one-half inch tall microphone capable of transmitting sounds as an input device.

Also included within carriage 105 are various output devices 115 used to enable the user to receive data from the present invention. Output devices 115 can be any type of device used to display or communicate data to the user, including visual displays such as liquid crystal displays ("LCD") and light emitting devices, and audio devices such as speakers. The preferred embodiment of the present invention utilizes a combination of output devices 115, including an LCD display and a speaker.

The LCD display is a 128 by 64 pixel display, large enough to enable the user to view as many as eight distinct lines of data as text information, with each distinct line of data containing up to sixteen individual text characters. Alternately, the entire 128 by 64 pixel display can be utilized to represent graphical information. Applicable LCD displays capable of being utilized with the present invention include a Seiko G1216, an Optrex DMF50427NJ, or industry equivalents.

The speaker device is of sufficient size to fit within carriage 105 yet is powerful enough to broadcast data in an audio manner that can be heard by the user. The preferred embodiment of the present invention utilizes a one-half watt, one and one-half inch diameter speaker to output data.

The present invention can utilize input and output devices in the same configuration. For example, a microphone and a speaker can exist in the same device, operating as both input devices 110 and output devices 115.

Also included within carriage 105 is a power source 120 sufficiently capable of providing electrical power to operate the present invention. Power source 120 can be any device commonly used to provide electricity to handheld portable devices, including power cells such as alkaline-type batteries or rechargeable-type batteries, and an alternating current power supply device. The preferred embodiment of the present invention utilizes four "AA" size batteries of either the alkaline-type or rechargeable type. The power source 120 also employs an appropriate means both to initiate and terminate power operations to the present invention.

Also included within carriage 105 is a data processor 125 that executes instructions, transfers information, and operates to manipulate and transform data to accomplish various tasks. Data processor 125 also operates to transform verbal inputs to an appropriate form capable of manipulation and operation by other components of the present invention. Data processor 125 can be one device designed to perform all data operations of the present invention, including data manipulation and visual and audio operations.

The preferred embodiment of data processor 125 utilizes two components: a microprocessor and a digital signal processor. The microprocessor is one of many common transistor devices commercially available, such as the Intel 8051 microprocessor. The digital signal processor is one of many common integrated circuit devices capable of digital data operations, including audio recognition technology features and audio synthesis technology features, such as the DSP Communications, Inc. D6106 processor.

The microprocessor and digital signal processor operate as a voice-to-digital converter 127, a computer 128, and a voice synthesis device 129. Data can be received as input information from input devices 110 such as a microphone, is manipulated by the voice-to-digital converter 127, is processed by a computer 128, is manipulated by a voice synthesis device 129, and is transmitted through output devices 115 such as a speaker.

In particular, the digital signal processor is capable of manipulating speech inputs and outputs when operating the device through a voice-to-digital converter 127 and a voice synthesis device 129. The microprocessor acts as a computer 128 to process the input and output information. The preferred embodiment of the present invention uses both an Intel 8051 microprocessor and a DSP D6106 digital signal processor, or industry equivalents, as the data processor.

Also included within carriage 105 is a memory device 130 that allows data to be stored and retrieved. Memory device 130 can be any type of memory device with an appropriate method to access information, store information, retrieve information or delete information. One embodiment of memory device 130 is any type of semiconductor storage device with internal circuitry to manipulate data.

The preferred embodiment of memory device 130 utilizes several semiconductor memory devices, including static random access memory devices and read-only memory devices. Specifically, the preferred embodiment utilizes two static random access memory semiconductor devices attached to carriage 105.

The preferred embodiment also utilizes a removable memory unit system that is capable of being easily inserted into and out of carriage 105. This removable memory unit system has two components. The first component is a device adhering to Personal Computer Memory Card International Association ("PCMCIA") physical standards: typical PCMCIA cards are small, credit card-sized removable modules that provide easy expansion capabilities for portable computing devices. The removable memory unit further contains two read-only memory semiconductor devices. However, other removable-type memory devices including both read-only memory and random access memory may also be used as memory device 130. The second component of the removable memory unit system is a receptacle unit contained within carriage 105 that receives the first component and accommodates the manipulation of data between memory device 130 and the other components of the present invention.

Also included within carriage 105 is a data communication device 135 that allows data to be transmitted or otherwise transferred from the present invention to other devices. Data communication device 135 can be any type of device designed to transmit data from one device to another device, including external cables, a telecommunication device such as a modem, a radio frequency communication device, or an infrared device.

The preferred embodiment of the present invention utilizes infrared devices to transfer data, receive data, and convert infrared data transmissions to digital form. The transmission of data in infrared form is accomplished by an infrared light-emitting diode. The reception of data in infrared form is accomplished with an infrared-sensitive photo-transceiver. The infrared devices both generate and receive infrared transmissions, which are forms of electromagnetic radiation with frequencies in the electromagnetic spectrum in the range just below the frequency of visible red light. The infrared data communications devices transform data from digital form to infrared form and transmit this infrared data to other devices equipped to receive infrared communications. The infrared devices also receive infrared data and transform it to digital form.

Finally, included within carriage 105 is a communications channel 140. The various elements of the present invention, including input devices 110, output devices 115, power source 120, data processor 125, voice-to-digital converter 127, computer 128, voice synthesis device 129, memory device 130, and data communication device 135 are connected and interact with each other through communications channel 140. Communications channel 140 can be any device used to transmit signals, commands, and other data within and among the individual components, including wires, cables, or other internal circuitry. The preferred embodiment of the present invention utilizes internal hardware wiring as an internal bus to link specific elements to each other and provide for data transmission and operation.

2. General Operation

The present invention generally operates in the following manner. Prior to any relevant use or operation, the device must be capable of recognizing the user's vocal patterns. The present invention is capable of both speaker dependent voice recognition and speaker independent voice recognition. Speaker dependent voice recognition requires the use to "train" the device to recognize specific vocal patterns before reliable operation. Speaker independent voice recognition eliminates the need for a user to "train" the device, as the device is capable of recognizing a variety of vocal patterns for efficient operation.

The preferred embodiment of the present invention utilizes speaker dependent voice recognition. In most cases, the first time the device is used by a particular individual, that individual "personalizes" the device by selecting his or her name from a list of first names stored in and capable of being verbally synthesized by the device. The device then prompts the user with several vocal patterns; the user repeats and inputs these patterns to the device to create a collection of patterns the device can use for future operations. Other methods of recognizing an individual user's distinct vocal patterns can be employed by the device, such as configuring the device's memory with the vocal patterns before the device is ever used.

The user then operates the device by manipulating the input device in conjunction with prompts from the output device. For example, the user can view information displayed on a visual output device and then operate the device according to that displayed information by inputting response data through manual or audio devices. In addition, the user can receive information from an audio output device and then operate the device according to that audio information by inputting response data through manual or audio devices.

The device manipulates data by operation of all components employed in the device. The data processor 125, including voice-to-digital converter 127, computer 128, and voice synthesis device 129, receives inputs from the input device 110 or data communications device 135, manipulates the data, reads or writes data to and from the memory device 130, and outputs data through the output device 115. The data processor 125, including voice-to-digital converter 127, computer 128, and voice synthesis device 129, and in conjunction with the memory device 130, input device 110, output device 115, and data communication device 135, also can transmit and receive data to and from external devices such as printers or other computing devices. All internal data transmission among the various devices in the present invention occurs by use of the communications channel 140. In addition, the various devices in the present invention are operated by electrical power through the use of power source 120.

Golf related operations are possible using the present invention by the use of a removable PCMCIA-type memory device preloaded with data relevant to golfing, connected to other elements of the present invention. When configured with this particular memory device, the golf scorekeeper utilizes audio recognition technology features and audio synthesis technology features to present a voice-operated golf course database and scoring device. The device is capable of pronouncing the user's name and recognizing the user's pronunciation of numerous words.

The device acts as a golf course database, with the ability to present the name, slope and course rating, telephone number, city, state, and zip code of over 10,000 American golf courses. The device also presents the par, distance, and yardage from the men's, women's and championship tees for all holes present at those golf courses. The device further has the capability of adding information regarding golf courses not stored in the database to the device's memory.

In addition, the device acts as a golf scorekeeper, capable of keeping score for up to four golfers at one time. During play, at the completion of one hole of golf the user enters in either a verbal or manual manner certain items of information, such as the number of strokes per hole, number of putts per hole, number of strokes out of bounds, number of strokes in water, number of sand saves, and similar data. The device then instantaneously calculates, saves in memory, and visually displays each golfer's gross score, net score, and number of putts. The device also displays a running total of gross and net scores of the round, as well as the gross and net score for the previous two holes. The device is capable of keeping score according to stroke play, match play, or skins play. The device is also capable of accurately recording and displaying the current time and date.

Prior to beginning play at any individual hole, the device outputs information regarding the hole, including the name and par and yardage information for the men's, women's, and championship tees. The device also computes the tee order among the golfers and outputs that tee order information to the user, typically by announcing through the speaker the individual tee order.

After each round of golf, the device stores information including the final score, number of drives in fairway, number of putts, and number of greens reached in regulation. The device, which can store information pertaining to numerous rounds, can manipulate the stored data and output the information in an analytical manner. For example, the device can perform a statistical analysis to indicate trends in an individual's golf game, including the percentage of drives located in the fairway, the percentage of greens reached in regulation, and the average number of putts.

The device is also capable of communicating with personal computers and printers through infrared transmissions. Data relevant to specific and cumulative golf rounds can be transferred from the device to a personal computer. Similarly, data relevant to specific and cumulative golf rounds can be transferred to a printer for immediate output.

Finally, the device can be configured for operations in other countries, including Japan and the United Kingdom, with applicable language capabilities and database information relevant to those other countries.

3. Specific Operation

Figure 4:
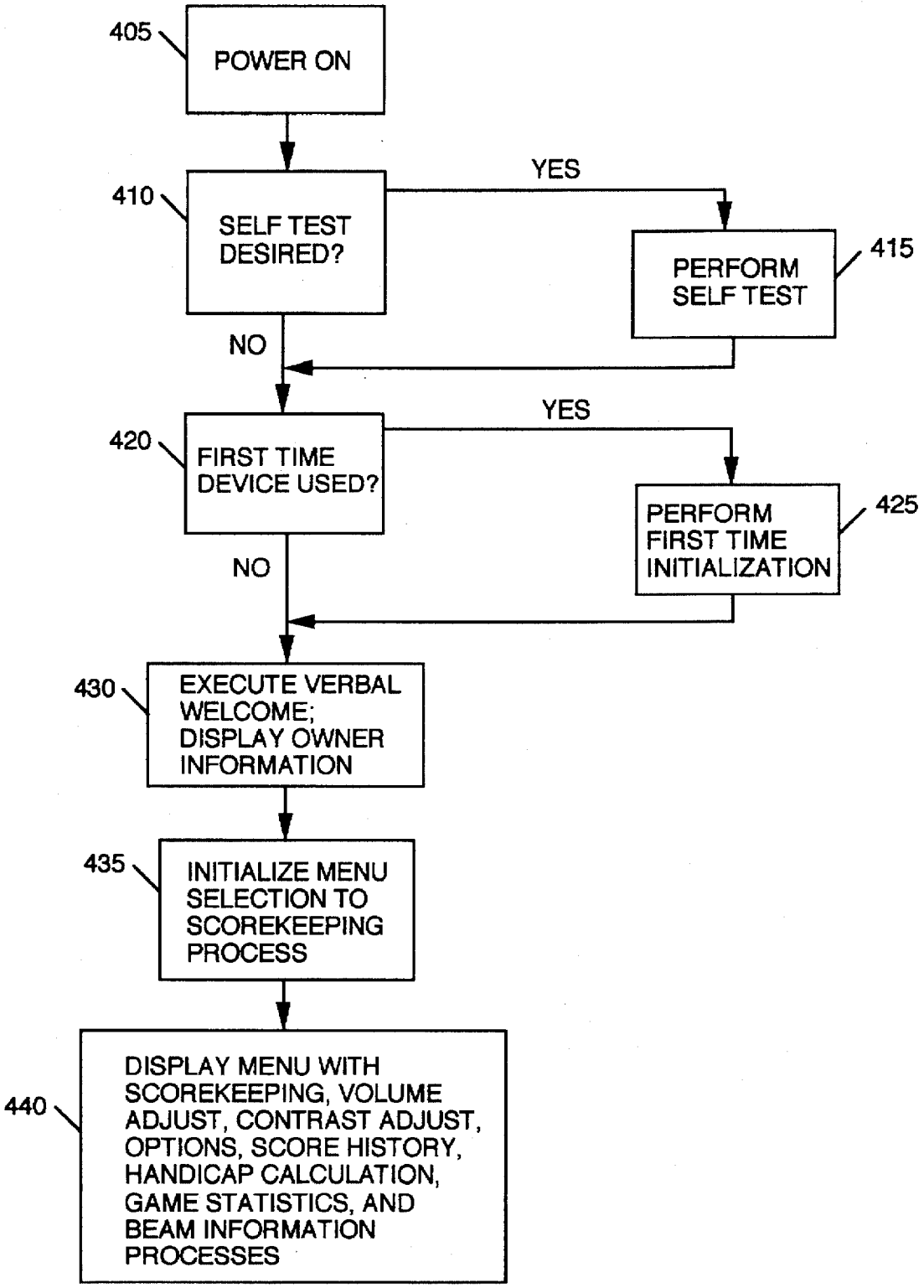
FIG. 4 depicts a flowchart of the operation of the main sequence process when the present invention acts as a golf scorekeeper.

More specifically, the present invention operates in the following manner. FIG. 4 depicts a flowchart of the operation of the main sequence process that exists when the present invention acts as a golf scorekeeper. Referring now to FIG. 4, when the user initiates power to the present invention (step 405), the user has the capability of performing a self test by pressing any button while simultaneously turning the power on (step 410). If the user requests a self test, that test is performed (step 415) and the device determines whether or not it has been previously operated (step 420). If the user does not request a self test, the device then determines whether or not it has been previously operated (step 420). If the device has not been previously operated, a first time initialization is performed (step 425), and the device executes a verbal welcome greeting and displays owner information (step 430). If the device has been previously operated, the device directly executes a verbal welcome greeting and displays owner information (step 430). The device next initializes its operation to the scorekeeping process (step 435) and displays a menu allowing the following options: the scorekeeping process, the volume adjust process, the contrast adjust process, the options process, the score history process, the handicap calculation process, and game statistics process, and the beam information process (step 440). If the user provides no inputs, the device continues to operate the scorekeeping process.

a. Self-Test Process

Figure 5:
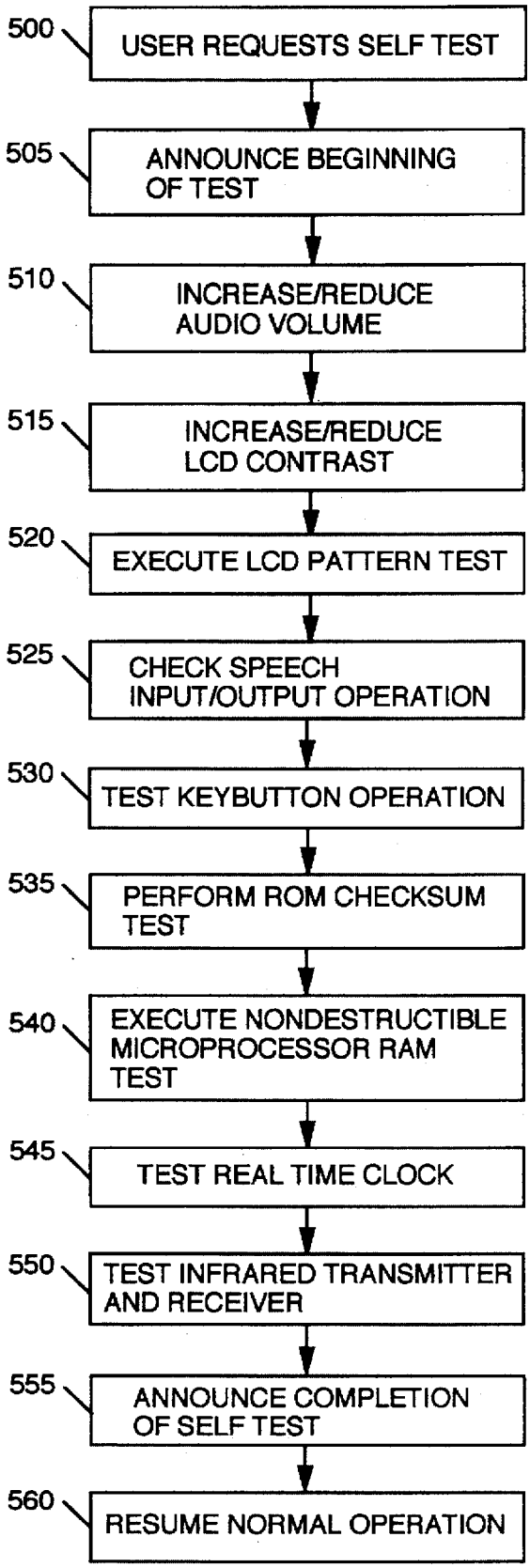
FIG. 5 depicts a flowchart of the operation of the self test process when the present invention acts as a golf scorekeeper.

Referring now to FIGS. 4 and 5, if the user desires a self test, the user inputs this request by simultaneously pressing any of the key buttons while turning the power on (step 500). The device then performs several tests to determine whether various components are operating properly.

In particular, the following sequence of operations occurs:

1) The device announces, both verbally through the speaker and visually through the LCD, the initiation of the self test process and instructs the user to observe both the audio output and the visual display (step 505). The self test process confirms the general operation of the data processor, including the microprocessor and the digital signal processor.

2) The device increases and reduces the audio volume to confirm the operation of digital control systems within the data processor (step 510).

3) The device increases and reduces the LCD contrast to confirm the operation of the LCD (step 515).

4) The device executes a LCD pattern test to confirm the operation of all pixels in the LCD display (step 520).

5) The device checks speech input and output operations (step 525). More specifically, the device instructs the user to speak a word into the microphone after an audio prompt, and repeats the word back to the user to confirm the proper operation of the data processor, its random access memory, its analog to digital and digital to analog converter, its speaker, its microphone, and associated amplifiers.

6) The device tests the operation of the five keybuttons (step 530); the device instructs the user to sequentially press the five keybuttons and monitors the depression of those keybuttons to confirm their correct operation.

7) The device performs a read-only memory checksum test (step 535), outputting the results to the LCD.

8) The device executes a nondestructive microprocessor random access memory test (step 540), outputting the results to the LCD.

9) The device tests the real time clock (step 545), outputting the results to the LCD.

10) The device tests the infrared transmitter and receiver (step 550); the device instructs the user to point the infrared transmitter and receiver component of the handheld device to a suitable receiver and press a keybutton, and the device monitors these operations to confirm the correct operation of the infrared transmitter and receiver.

11) The device announces, both by audio and visual means, the completion of the self test (step 555).

12) The device enables the user to resume normal operations by pressing any key (step 560).

b. First-Time Initialization

Figure 6:
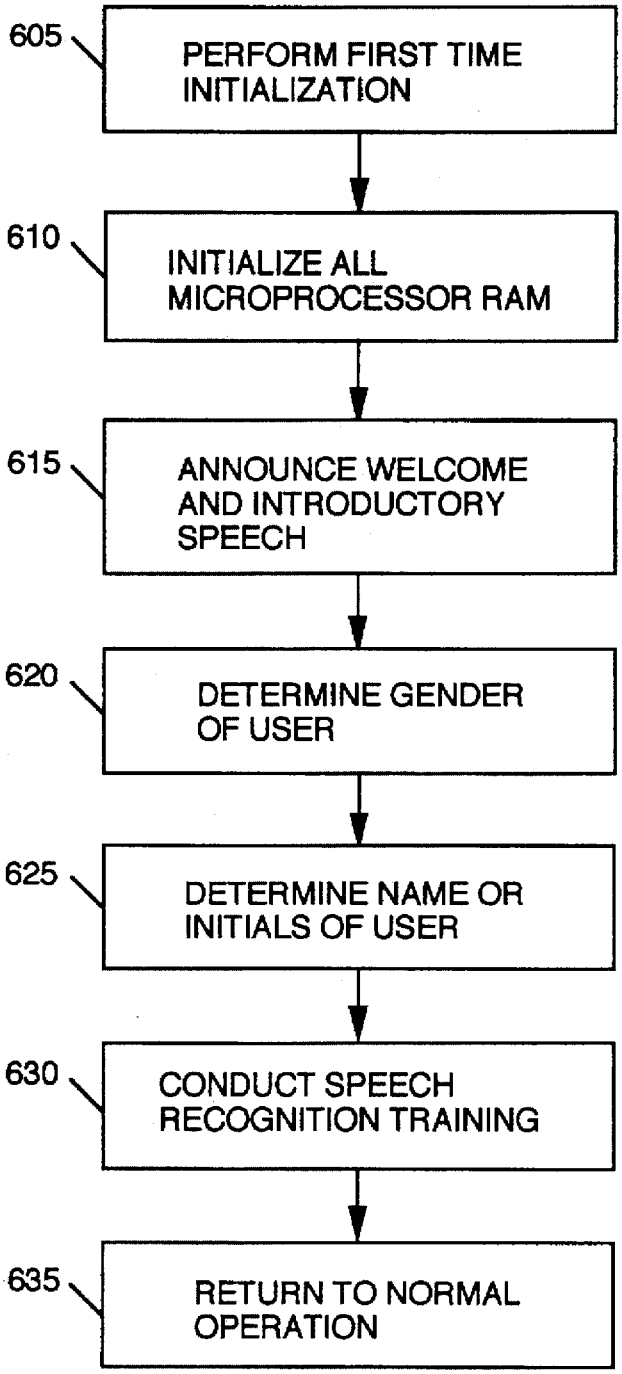
FIG. 6 depicts a flowchart of the operation of the first time initialization process when the present invention acts as a golf scorekeeper.

Referring now to FIGS. 4 and 6, the device determines whether or not it has been previously operated (step 420). If first time operation is detected, the device performs a first time initialization process (step 605), and the device conducts several actions required for further use of the device, such as memory initialization, user name or initials determination, and gender determination. The device also guides the user through speech recognition training to understand the user's pronunciation of the approximately fifty words used by the device. In particular, the following sequence of operations occurs:

1) The device initializes all microprocessor random access memory (step 610).

2) The device announces a preset welcome and introductory speech (step 615).

3) The device determines the user's gender (step 620). The device instructs the user to select the appropriate gender currently displayed on the LCD by using the UP and DOWN keybuttons to highlight their choice and then by pressing the ENTER keybutton to make their selection. The device then records the user's gender response in its memory.

4) The device determines the user's name or initials (step 625). The device requests the user to select their name from a list of approximately three hundred names; the appropriate gender for the name list is calculated by reference to the actions of step 620. The device instructs the user to make a selection from the name list currently displayed on the LCD by using the UP and DOWN keybuttons to highlight their choice and then by pressing the ENTER keybutton to make their selection. The LCD can only display seven items from the list at a time, but the device will scroll the list up and down, as controlled by the user, by operation of the UP and DOWN keybuttons. The device further requests the user to enter their initials if their name is not found on the list.

5) The device conducts speech recognition training with appropriate user inputs (step 630). To conduct this speech recognition, the device directs the user by audio output that the user must repeat twice the approximately fifty words used by the golf application. The device then sequentially outputs by audio means approximately fifty golf relevant words, one at a time, requesting the user to repeat each word after output by the device and an audio beep. After-each word repetition by the user, the device checks the user's output of the individual words to determine if the user's volume was adequate, repeating the word input prompt if the user's volume was too low or too high. After the entire list of approximately fifty words have been through the prompt and response process, with audio check, the device goes through a second speech recognition operation similar to the first, requesting the user to again repeat each of the approximately fifty golf relevant words after output by the device and an audio beep. The device again checks the user's output of the individual words to determine if the user's volume was adequate, repeating the word input prompt if the user's volume was too high or too low. The device then compares the first input for each individual word with the second input for each individual word to determine if the two inputs are similar. The device repeats the second word input process for each individual word until the first and second inputs are acceptably similar.

6) The device enables the user to resume normal operations by pressing any key (step 635).

c. Scorekeeping Process

Figure 7:
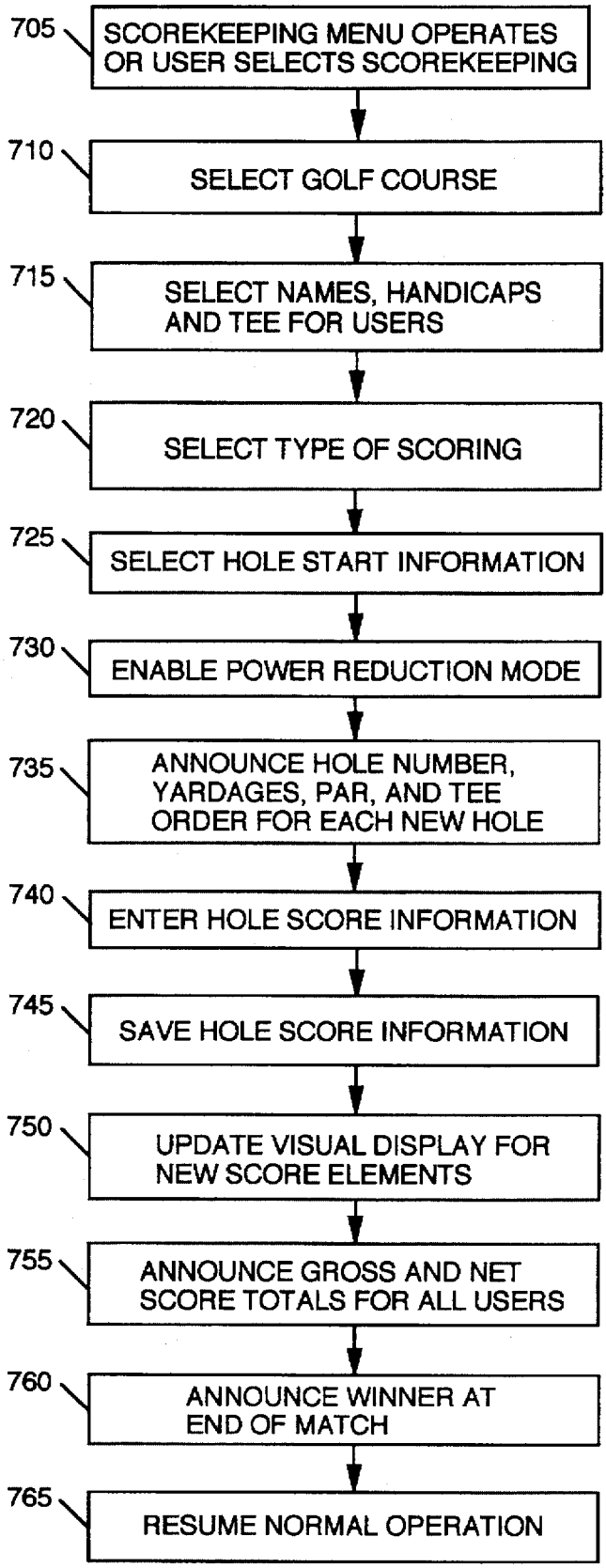
FIG. 7 depicts a flowchart of the operation of the scorekeeping process when the present invention acts as a golf scorekeeper.

Referring now to FIGS. 4 and 7, the device, after any applicable self test or initialization processes and appropriate greetings, begins the scorekeeping process (step 435). In addition, the scorekeeping process may occur if the user requests the scorekeeping process from a main sequence process menu option (step 440 and step 705). The scorekeeping process prompts the user for all inputs required for a new golf match and then performs all normal scorekeeping functions that occur on the golf course. Prior to each hole the device announces the hole number, yardages, and par for each particular tee (either championship, men's, or women's) and announces the golfer tee-off order. After completion of the hole, the device records strokes, putts, and any special inputs by the user such as fairways reached in regulation, sand saves, and shots out of bounds. The device then announces the running total scores for each golfer, and, at the end of play, announces the winner. In particular, the following sequence of operations occurs:

1) The user inputs the appropriate golf course that will be used for play (step 710). To input this information, the user is given the option of choosing the appropriate golf course by state, by city, or by area code. The user chooses the appropriate choice by using the UP and DOWN keybuttons to highlight their choice and then pressing ENTER keybutton to make the selection. After selection, the designated golf courses relevant to that choice are sorted and listed on the display; the user selects the appropriate golf course by using the UP and DOWN keybuttons to highlight their choice and then pressing the ENTER keybutton to make the selection.

2) The device prompts the user to select the names, handicaps, and particular tee (either championship, men's, or women's) applicable to all golfers of a particular match (step 715).

3) The device prompts the user to select the type of scoring, either stroke play, match play, or skins play, applicable to the particular match (step 720).

4) The device prompts the user to select the particular hole on the golf course on which play will begin (step 725).

5) The device enables a power reduction mode, so that power consumption is reduced during play when the device is not in use (step 730). Power reduction mode is disabled whenever any keybutton is depressed, and resumed after a suitable length of time when hole information has been presented.

6) Prior to teeing off at a hole, the device announces the hole number, yardages, and par for the upcoming hole. The device also announces the tee order for the upcoming hole (step 735).

7) After play on a hole is completed, the device prompts the user to enter hole score information for each golfer (step 740). The device instructs the user to enter the number of strokes and number of putts for the hole for all golfers, and any special input desired by any of the individual golfers.

8) The device saves in its memory the hole score information (step 745).

9) The device updates the visual display of all score elements, including gross score, net score, and number of putts for all golfers (step 750).

10) The device announces in a verbal manner the gross and net score totals for all golfers (step 755).

11) After the end of the match, the device announces the name of the winner (step 760).

12) The device enables the user to resume normal operations by pressing any key (step 765).

d. Volume Adjust Process

Figure 8:
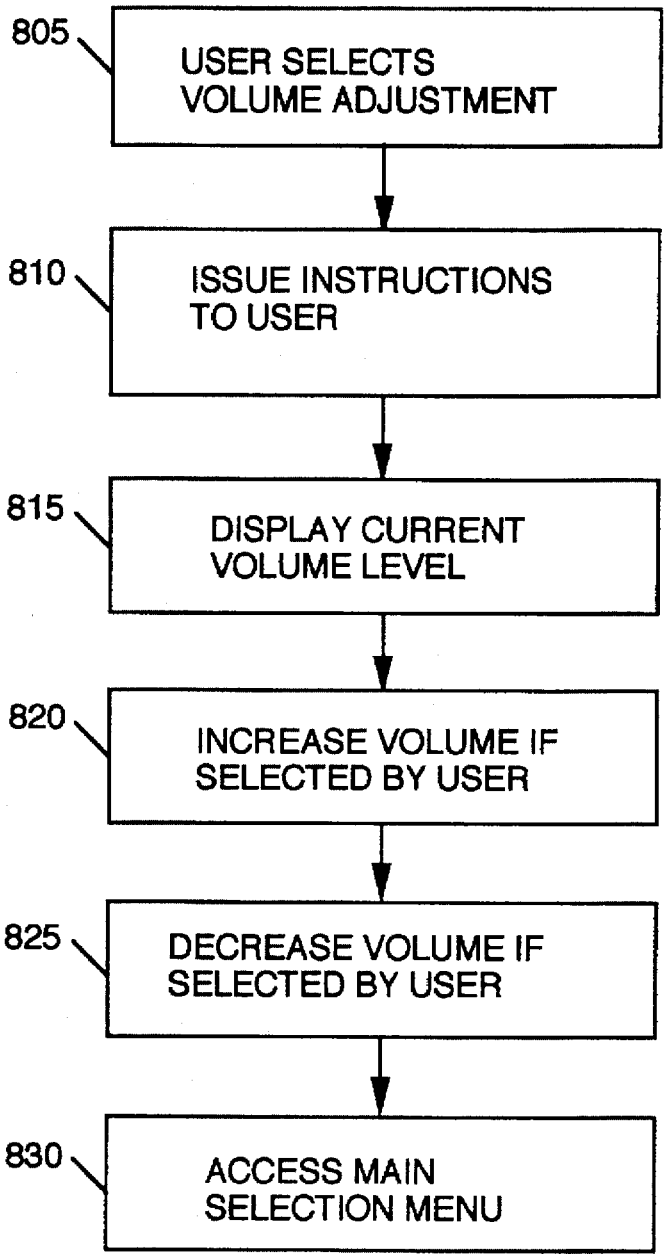
FIG. 8 depicts a flowchart of the operation of the volume adjust process when the present invention acts as a golf scorekeeper.

Referring now to FIGS. 4 and 8, the device displays a menu offering several selections, including the option to initiate the volume adjust process, from the main selection menu (step 440). The user may select the volume adjust process from the main selection menu process (step 805). During the volume adjust process, the device accepts inputs from the user and adjusts the device's speaker volume. In particular, the following sequence of operations occurs:

1) The device issues instructions to the user for volume adjustment (step 810). The device instructs the user that the UP and DOWN keybuttons will adjust the volume, and to press the ENTER keybutton when done.

2) The device displays the current volume level on the LCD (step 815).

3) The device increases the speaker volume if the user pushes the UP keybutton (step 820).

4) The device decreases the speaker volume if the user pushes the DOWN keybutton (step 825).

5) The device accesses the main selection menu process if the user presses the ENTER keybutton (step 830).

e. Contrast Adjust Process

Figure 9:
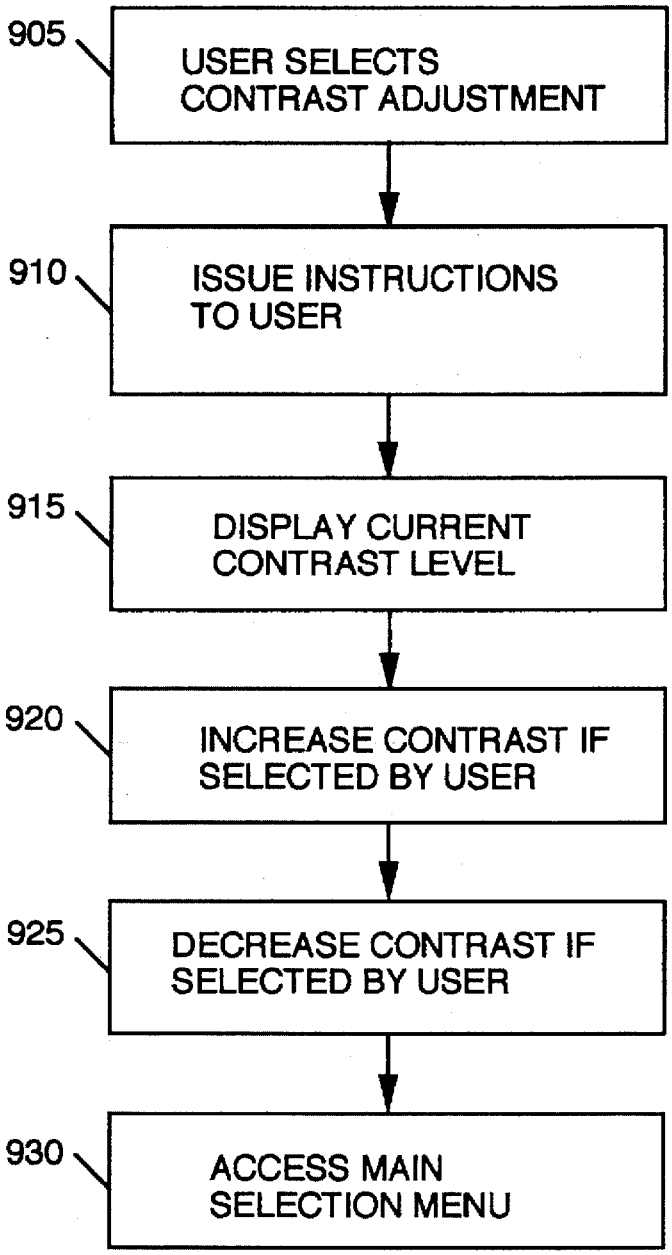
FIG. 9 depicts a flowchart of the operation of the contrast adjust process when the present invention acts as a golf scorekeeper.

Referring now to FIGS. 4 and 9, the device displays a menu offering several selections, including the option to initiate the contrast adjust process, from the main selection menu (step 440). The user may select the contrast adjust process from the main selection menu process (step 905). During the contrast adjust process, the device accepts inputs from the user and adjusts the device's LCD display contrast. In particular, the following sequence of operations occurs:

1) The device issues instructions to the user for contrast adjustment (step 910). The device instructs the user that the UP and DOWN keybuttons will adjust the display contrast, and to press the ENTER keybutton when done.

2) The device displays the current contrast level on the LCD (step 915).

3) The device increases the contrast level if the user pushes the UP keybutton (step 920).

4) The device decreases the contrast level if the user pushes the DOWN keybutton (step 925).

5) The device accesses the main selection menu process if the user presses the ENTER keybutton (step 930).

f. Options Process

Figure 10:
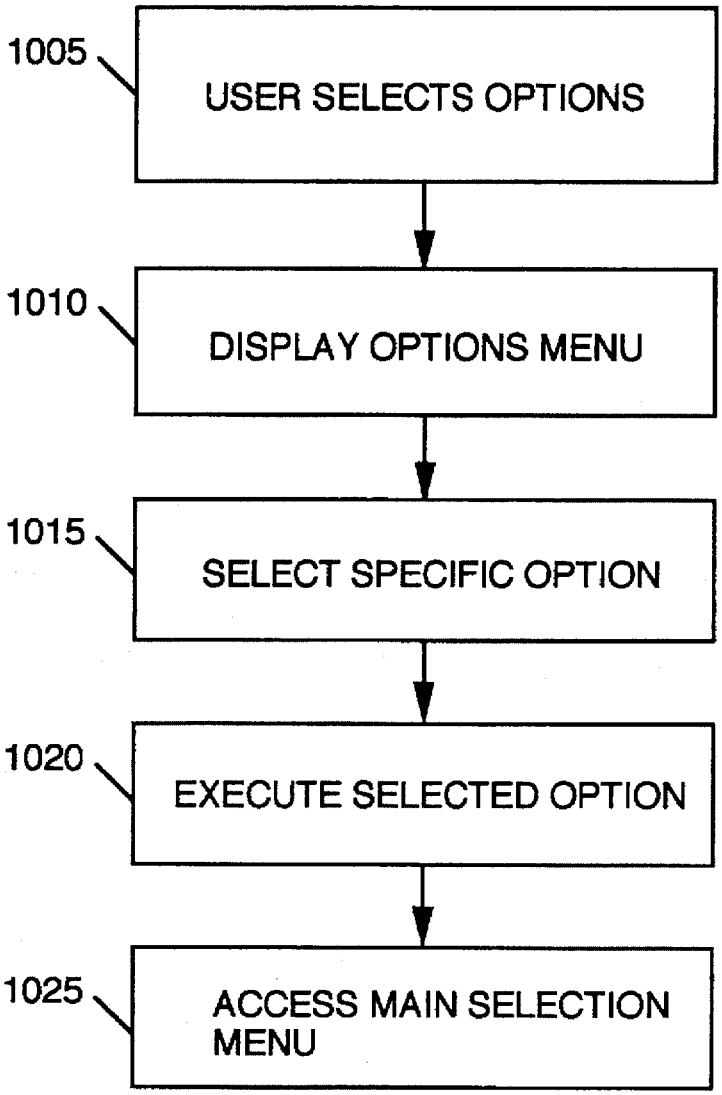
FIG. 10 depicts a flowchart of the operation of the options process when the present invention acts as a golf scorekeeper.

Referring to FIGS. 4 and 10, the device displays a menu offering several selections, including the option to initiate the options process, from the main selection menu (step 440). The user may select the options process from the main selection menu process (step 1005). During the options process, the device allows the user to accomplish many unique features and customize many operational aspects of the product. In particular, the following sequence of operations occurs:

1) The device displays an options menu (step 1010), offering the ability to conduct the following operations: relearn all words, relearn one word, change owner information, add new course, change narration speed, change narration amount, change scoring features, erase scores, limit tee display, conduct a self test, enter time, and enter date.

2) The user selects an option from the currently displayed list by using the UP and DOWN keybuttons to highlight their choice and then by pressing the ENTER keybutton to make their selection (step 1015).

3) The device executes the selected option and takes appropriate actions to accommodate user's selection (step 1020).

4) Upon completion of the selected option, the device accesses the main selection menu process (step 1025).

g. Score History Process

Figure 11:
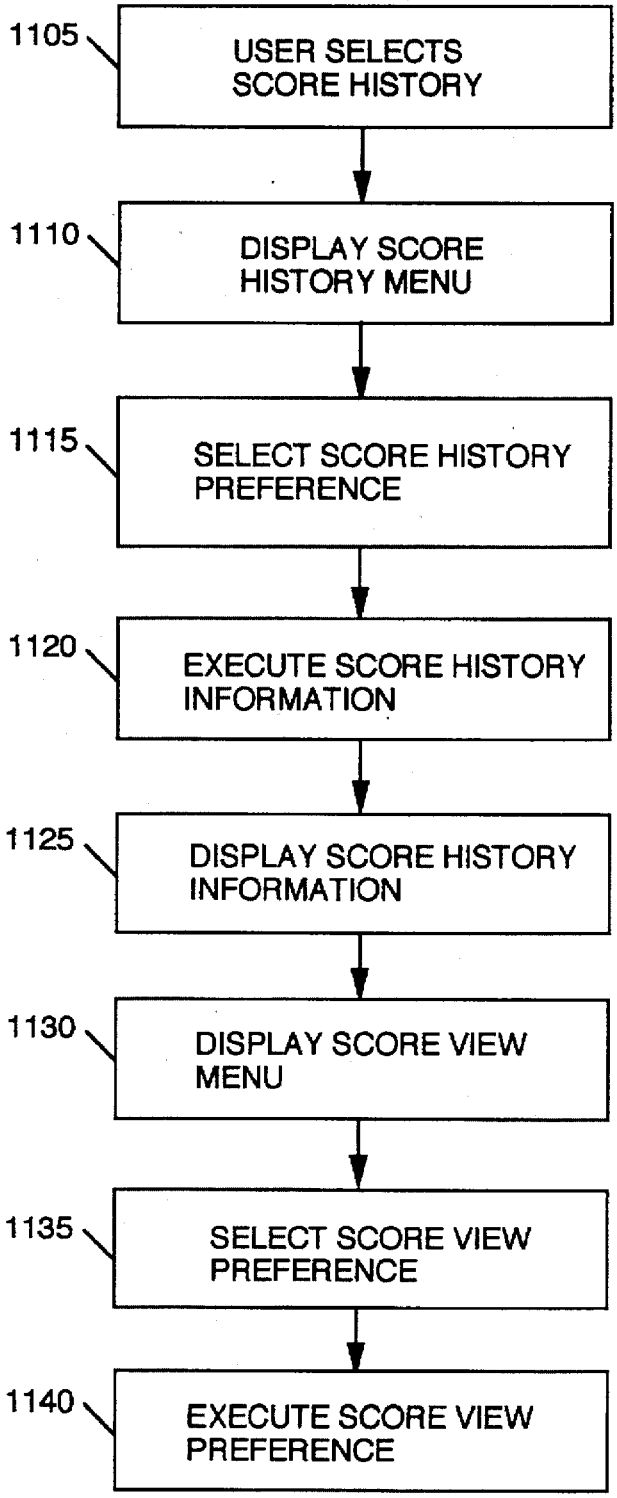
FIG. 11 depicts a flowchart of the operation of the score history process when the present invention acts as a golf scorekeeper.

Referring to FIGS. 4 and 11, the device displays a menu offering several selections, including the option to initiate the score history process, from the main selection menu (step 440). The user may select the score history process from the main selection menu process (step 1105). During the score history process, the device allows the user to review and edit prior scores according to various user preferences. In particular, the following sequence of operations occurs:

1) The device displays a score history menu (step 1110), offering the ability to conduct score history operations according to the following parameters: by date, by course, by opponent, by best gross score, by worst gross score, by best net score, and by worst net score.

2) The user selects a score history preference from the currently displayed list by using the UP and DOWN keybuttons to highlight their choice and then by pressing the ENTER keybutton to make their selection (step 1115).

3) The device executes the selected score history preference and takes appropriate actions to accommodate user's selection (step 1120).

4) The device displays the selected score history preference information (step 1125). In particular, if by date is selected the device displays all scores chronologically, most recent first. If by course is selected, the device guides the user through the course selection process. When course selection is completed, the device displays all scores from that course chronologically, most recent first. If by opponent is selected, the device guides the user through an opponent name selection process. When the opponent name selection process is completed, the device displays all scores with that opponent chronologically, most recent first. If by best gross score is selected, the device displays all scores ranked by gross score, with best gross scores first. If by worst gross score is selected, the device displays all scores ranked by gross score, with worst gross scores first. If by best net score is selected, the device displays all scores ranked by net score, with best net scores first. Finally, if by worst net score is selected, the device displays all scores ranked by net score, with worst net scores first.

5) After display of the score history information, the device displays a score view menu (step 1130), offering the ability to conduct the following score view operations: next, previous, edit, and exit.

6) The user selects a score view preference, in which the user selects a method for displaying prior scores from the list of options displayed in step 1130 by using the LEFT and RIGHT keybuttons to highlight their choice and then by pressing the ENTER keybutton to make their selection (step 1135).

7) The device executes the selected score view preference and takes appropriate actions to accommodate user's selection (step 1140). In particular, if next is selected, the device displays the next sorted score. If previous is selected, the device displays the previous sorted score. If edit is selected, the device allows the user to edit the displayed score. Finally, if exit is selected, the device completes the score view preference operations.

h. Handicap Calculation Process

Figure 12:
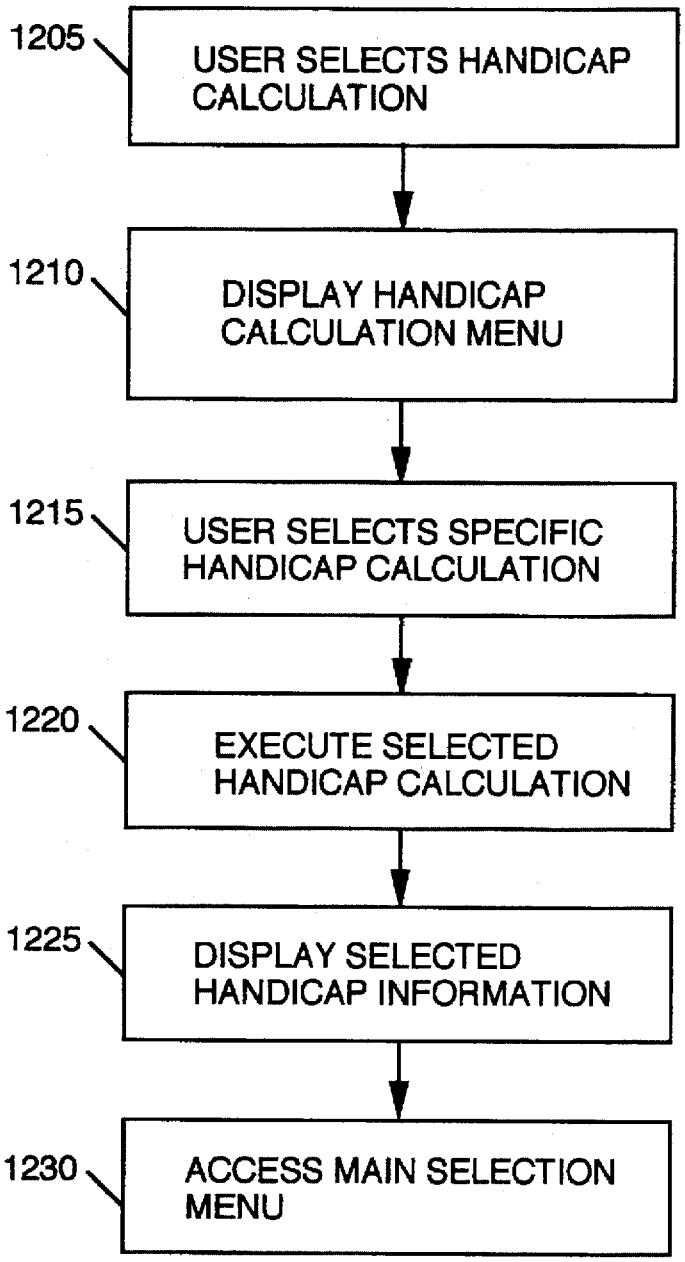
FIG. 12 depicts a flowchart of the operation of the handicap calculation process when the present invention acts as a golf scorekeeper.

Referring to FIGS. 4 and 12, the device displays a menu offering several selections, including the option to initiate the handicap calculation process, from the main selection menu (step 440). The user may select the handicap calculation process from the main selection menu process (step 1205). During the handicap calculation process, the device allows the user to review the most recent scores and calculate the user's handicap. In particular, the following sequence of operations occurs:

1) The device displays a handicap calculation menu (step 1210), offering the ability to conduct handicap operations according to the following menu options: compute handicap, review scores, and handicap history.

2) The user selects a handicap calculation option from the currently displayed list by using the UP and DOWN keybuttons to highlight their choice and then by pressing the ENTER keybutton to make their selection (step 1215).

3) The device executes the selected handicap calculation option and takes appropriate actions to accommodate the user's selection (step 1220).

4) The device displays the selected handicap calculation information (step 1225). In particular, if compute handicap was selected the device computes the user's handicap using standard handicap formulas manipulating the user's most recent scores. The display saves, displays, and announces the handicap to the user. If review scores was selected, the device displays the most recent scores used as a basis for handicap calculation. If handicap history was selected, the device displays the results and dates of previous handicap calculations.

5) The device accesses the main selection menu process if the user presses the ENTER keybutton (step 1230).

i. Game Statistics Process

Figure 13:
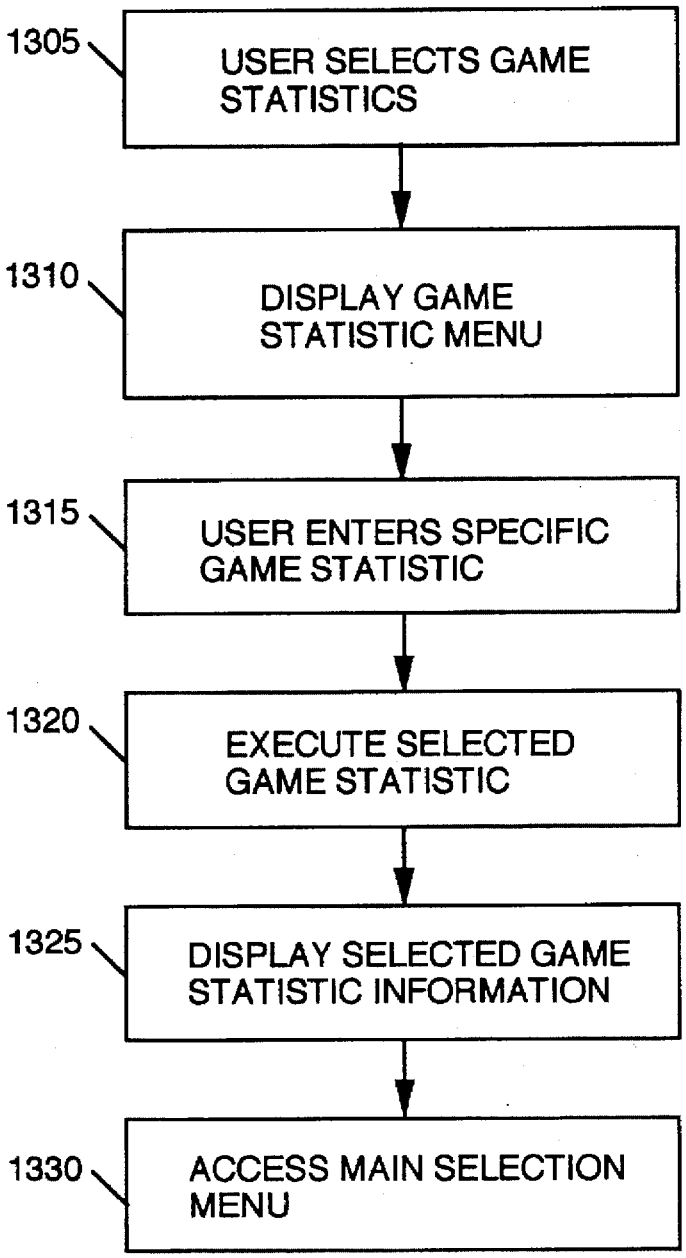
FIG. 13 depicts a flowchart of the operation of the game statistics process when the present invention acts as a golf scorekeeper.

Referring to FIGS. 4 and 13, the device displays a menu offering several selections, including the option to initiate the game statistics process, from the main selection menu (step 440). The user may select the game statistics process from the main selection menu process (step 1305). During the game statistics process, the device allows the user to review their statistical performance on significant aspects of their golf game. In particular, the following sequence of operations occurs:

1) The device displays a game statistics menu (step 1310), offering the ability to conduct recent statistics and long term statistics operations.

2) The user selects a game statistics option from the currently displayed list by using the UP and DOWN keybuttons to highlight their choice and then by pressing the ENTER keybutton to make their selection (step 1315).

3) The device executes the selected game statistic option and takes appropriate actions to accommodate the user's selection (step 1320).

4) The device displays the selected game statistic information (step 1325). In particular, if recent statistics was selected the device computes and displays the following information for the last round, last five rounds, and last ten rounds: the gross score, net score, fairways percentage, greens percentage, average putts, birdie percentage, par percentage, bogey percentage, double bogey percentage, and scores higher than double bogey percentage. If long term statistics was selected, the device computes and displays the following information for the last ten rounds, for the previous eleven through twenty rounds, and for the previous twenty-one through thirty rounds.

5) The device accesses the main selection menu process if the user presses the ENTER keybutton (step 1330).

j. Beam Information Process

Figure 14:
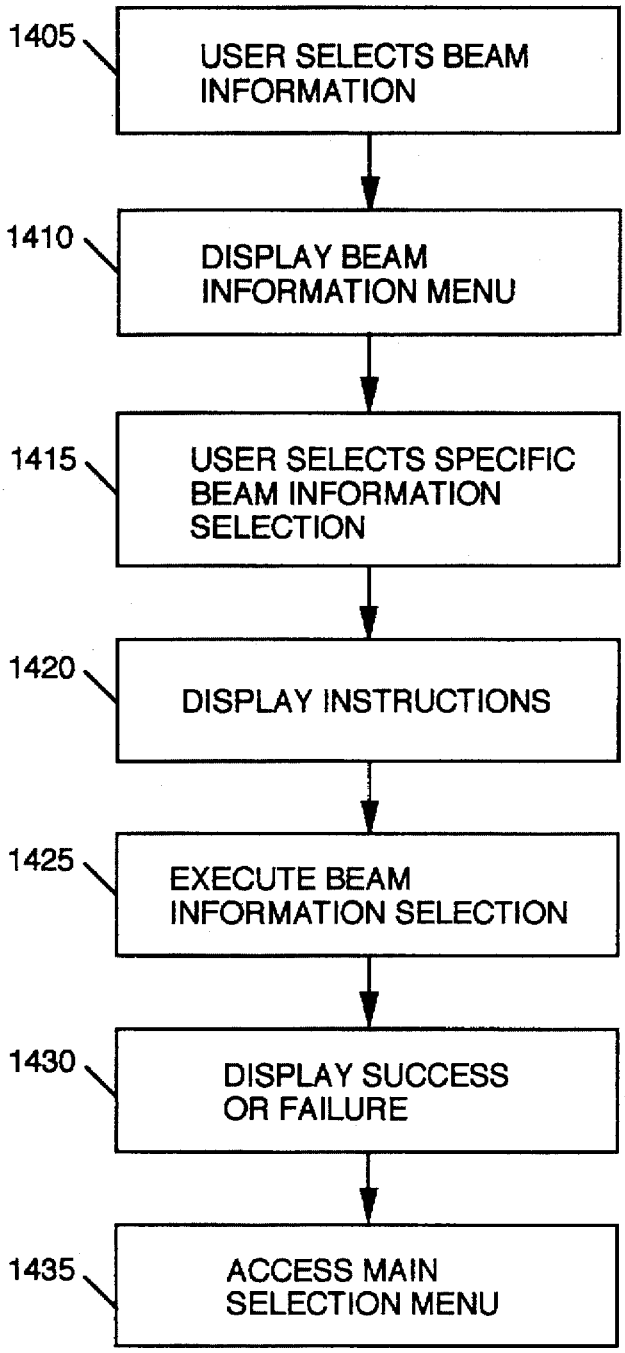
FIG. 14 depicts a flowchart of the operation of the beam information process when the present invention acts as a golf scorekeeper.

Referring to FIGS. 4 and 14, the device displays a menu offering several selections, including the option to operate the beam information process, from the main selection menu (step 440). The user may select the beam information process from the main selection menu process (step 1405). During the beam information process, the device allows the user to beam information, wither the current displayed score or all scores, to a printer or other personal computer, or allows the user to receive information from an external device. The beam information process transfers data through an infrared digital communication from one device to another. In particular, the following sequence of operations occurs:

1) The device displays a beam information menu (step 1410), offering the ability to transfer the current displayed score to a personal computer, to transfer all scores to a personal computer, to transfer the current displayed score to a printer, or to receive information from an external device.

2) The user selects a beam information process option from the currently displayed list by using the UP and DOWN keybuttons to highlight their choice and then by pressing the ENTER keybutton to make their selection (step 1415).

3) The device then outputs instructions to the user to point the device towards the external device and press the ENTER keybutton to begin data transfer (step 1420).

4) The device executes the selected beam information option and takes appropriate actions to accommodate the user's selection (step 1425). The device attempts to transfer either the current score or all scores to a personal computer or printer, or to receive information from an external device, depending on the user's prior selections, and determines whether or not data transfer was successful.

5) The device displays the success or failure of the data transfer to the user (step 1430).

6) The device accesses the main selection menu process if the user presses the ENTER keybutton (step 1435).

4. Conclusion

The handheld data processing device can be converted to uses other than a golf scorekeeper. For example, the device can be used as a voice-operated, handheld portable hotel and restaurant database and data processing device, controlling information germane to the hotel and restaurant industries. In addition, the device can be used as a voice-operated, handheld portable business expense account processor, controlling information specific to expenses incurred during certain events.

As will be understood by those skilled in the arts many changes in the apparatus and methods described above may be made by the skilled practitioner without departing from the spirit and scope of the invention, which should be limited only as set forth in the claims which follow.

What is claimed is:

1. A portable golf scorekeeping apparatus providing voice input and output for processing golf scorekeeping data for one or more end users playing a round of golf on any golf course, comprising:

a memory for storing data used in a plurality of golf scorekeeping operations;

a speaker for transmitting voice output information to a user;

a microphone for receiving voice input information including scoring data and golf course selection data;

a voice-to-digital converter for converting voice input information to golf scorekeeping data, said voice-to-digital converter coupled to said microphone and said memory;

a voice synthesis apparatus for processing golf scorekeeping data to output information, said voice synthesis apparatus coupled to said speaker and said memory;

a golf input module for storing golfing data including information associated with a plurality of golf courses;

a computer for processing the golf scorekeeping data and golfing data, said computer coupled to said memory, said voice-to-digital converter, said golf input module and said voice synthesis apparatus;

a portable frame sized to hold said memory, said speaker, said microphone, said voice-to-digital converter, said voice synthesis apparatus, said golf input module and said computer; and wherein said computer processes golf scorekeeping data by receiving the voice input information as audio input signals from the microphone, converting the voice input information to golf scorekeeping data, manipulating the golf scorekeeping data with data stored in said memory, synthesizing the golf scorekeeping data to output information, and transmitting the output information as audio output signals to the user.

2. The apparatus of claim 1, wherein said speaker and said microphone constitute the same device.

3. The apparatus of claim 1, further comprising:

a data transmission apparatus for transferring the golf scorekeeping data to at least one external device; and a data reception apparatus for receiving golf scorekeeping data from at least one external device.

4. The apparatus of claim 3, wherein said data transmission apparatus and said data reception apparatus constitute the same device.

5. A portable golf scorekeeping apparatus providing voice input and output for processing golf scorekeeping data for one or more end users playing a round of golf on any golf course, comprising:

a memory for storing data used in a plurality of golf scorekeeping operations;

a speaker for transmitting output information to a user;

a microphone for receiving input information;

a voice-to-digital converter for converting input information to golf scorekeeping data, said voice-to-digital converter coupled to said microphone and said memory;

a voice synthesis apparatus for processing golf scorekeeping data to output information, said voice synthesis apparatus coupled to said speaker and said memory;

a computer for processing the golf scorekeeping data, said computer coupled to said memory, said voice-to-digital converter, and said voice synthesis apparatus;

a portable frame sized to hold said memory, said speaker, said microphone, said voice-to-digital converter, said voice synthesis apparatus and said computer;

an initialization routine executable by said computer for initializing said golf scorekeeping system, said initialization routine triggerable by a user to determine information about the user by prompting the user with voice information from said voice synthesis apparatus and thereafter receiving input voice information from the user at said voice-to-digital converter for processing by said computer; and wherein said computer processes golf scorekeeping data by receiving the input information as audio input signals from the microphone, converting the input information to golf scorekeeping data, manipulating the golf scorekeeping data with data stored in said memory, synthesizing the golf scorekeeping data to output information, and transmitting the output information as audio output signals to the user.

6. A portable golf scorekeeping apparatus providing voice input and output for processing golf scorekeeping data for one or more end users playing a round of golf on any golf course, comprising:

a memory for storing data used in a plurality of golf scorekeeping operations;

a speaker for transmitting output information to a user;

a microphone for receiving input information;

a voice-to-digital converter for converting input information to golf scorekeeping data, said voice-to-digital converter coupled to said microphone and said memory;

a voice synthesis apparatus for processing golf scorekeeping data to output information, said voice synthesis apparatus coupled to said speaker and said memory;

a computer for processing the golf scorekeeping data, said computer coupled to said memory, said voice-to-digital converter, and said voice synthesis apparatus;

a portable frame sized to hold said memory, said speaker, said microphone, said voice-to-digital converter, said voice synthesis apparatus and said computer;

a display and a selector for selecting scorekeeping options for said golf scorekeeping system, said selector triggerable by said user to display selections on said display for a plurality of scorekeeping options, said voice-to-digital converter receiving data from the user to indicate a selection for a scorekeeping option and said computer processing the user's selection for a scorekeeping option; and wherein said computer processes golf scorekeeping data by receiving the input information as audio input signals from the microphone, converting the input information to golf scorekeeping data, manipulating the golf scorekeeping data with data stored in said memory, synthesizing the golf scorekeeping data to output information, and transmitting the output information as audio output signals to the user.

7. A portable golf scorekeeping apparatus providing voice input and output for processing golf scorekeeping data for one or more end users playing a round of golf on any golf course, comprising:

a memory for storing data used in a plurality of golf scorekeeping operations;

a speaker for transmitting output information to a user;

a microphone for receiving input information;

a voice-to-digital converter for converting input information to golf scorekeeping data, said voice-to-digital converter coupled to said microphone and said memory;

a voice synthesis apparatus for processing golf scorekeeping data to output information, said voice synthesis apparatus coupled to said speaker and said memory;

a computer for processing the golf scorekeeping data, said computer coupled to said memory, said voice-to-digital converter, and said voice synthesis apparatus;

a portable frame sized to hold said memory, said speaker, said microphone, said voice-to-digital converter, said voice synthesis apparatus and said computer;

a score keeping routine including an input module for receiving voice input data from the user including a golf course, names, handicaps, tee preference, scoring system selection, and hole information for the hole at which play will begin;

a status module for transmitting data to the user to indicate hole information, user tee order for each new hole encountered by the user at a golf course and user's score; and a scoring module for receiving input voice information from the user to indicate the user's score for a completed hole of golf and for storing said input voice information; and wherein said computer processes golf scorekeeping data by receiving the input information as audio input signals from the microphone, converting the input information to golf scorekeeping data, manipulating the golf scorekeeping data with data stored in said memory, synthesizing the golf scorekeeping data to output information, and transmitting the output information as audio output signals to the user.

8. The apparatus of claim 7 wherein said scoring module further includes a gross and net scoring module for calculating a user's gross and net scores after completion of a hole and wherein said status module transmits data to the user to indicate the user's gross and net scores.

9. The apparatus of claim 8, wherein said scoring module determines a user with the lowest score after completion of all holes and wherein said status module transmits data to the user to indicate the user with the lowest score.

10. The apparatus of claim 7 wherein said scoring module further includes a handicap module for receiving data from a user to calculate the user's handicap and wherein said status module transmits data to the user to indicate the calculated handicap.

11. The apparatus of claim 7 further including a statistics module for receiving data from a user to initiate a game statistics calculation procedure, for providing selections to the user for a plurality of game statistics features, for receiving data from the user to indicate a selection for a game statistic feature and for calculating the user's game statistics according to the user's selected game statistic feature.

* * * * *